US008749468B2

(12) United States Patent
Kobashi

(10) Patent No.: US 8,749,468 B2
(45) Date of Patent: Jun. 10, 2014

(54) SCANNER, ELECTRO-OPTICAL PANEL, ELECTRO-OPTICAL DISPLAY DEVICE AND ELECTRONIC APPARATUS

(75) Inventor: Yutaka Kobashi, Suwa (JP)

(73) Assignee: Japan Display West Inc., Aichi-Ken (JP)

( * ) Notice: Subject to any disclaimer, the term of this patent is extended or adjusted under 35 U.S.C. 154(b) by 1123 days.

(21) Appl. No.: 12/717,991

(22) Filed: Mar. 5, 2010

(65) Prior Publication Data

US 2010/0238092 A1 Sep. 23, 2010

(30) Foreign Application Priority Data

Mar. 6, 2009 (JP) ..... 2009-053031

(51) Int. Cl.
*G09G 3/36* (2006.01)

(52) U.S. Cl.
USPC ..... 345/100; 345/87

(58) Field of Classification Search
USPC ..... 345/87, 89, 98, 100, 690, 211, 212, 345/692, 693, 204
See application file for complete search history.

(56) References Cited

U.S. PATENT DOCUMENTS

| | | | | |
|---|---|---|---|---|
| 5,929,656 | A * | 7/1999 | Pagones | 326/83 |
| 6,072,354 | A * | 6/2000 | Tachibana et al. | 327/390 |
| 2003/0052848 | A1 | 3/2003 | Yamaguchi | |
| 2007/0195053 | A1 * | 8/2007 | Tobita et al. | 345/100 |

FOREIGN PATENT DOCUMENTS

| | | |
|---|---|---|
| JP | 2004-226429 | 8/2004 |
| JP | 3658349 B | 3/2005 |
| JP | 2005-149624 | 6/2005 |
| JP | 2008-537275 | 9/2008 |
| JP | 2008287134 A | 11/2008 |
| JP | 2009-181612 | 8/2009 |

OTHER PUBLICATIONS

Japanese Office Action issued Dec. 11, 2012 for corresponding Japanese Appln. No. 2009-053031.

* cited by examiner

*Primary Examiner* — Duc Dinh
(74) *Attorney, Agent, or Firm* — K&L Gates LLP

(57) ABSTRACT

A scanner includes a plurality of unit circuits configured with transistors of a same conductivity type. In the scanner, the unit circuit constituting the scanner includes an output transistor that selectively outputs, to an output terminal of the unit circuit, a signal given from an outside. A gate electrode of the output transistor is connected to one end of a voltage limiting transistor, and a gate electrode of the voltage limiting transistor is supplied with a first power supply potential.

6 Claims, 10 Drawing Sheets

SCANNER, ELECTRO-OPTICAL PANEL, ELECTRO-OPTICAL DISPLAY DEVICE AND ELECTRONIC APPARATUS

BACKGROUND

1. Technical Field

The present invention relates to a scanner, an electro-optical panel, an electro-optical display device including the electro-optical panel, and an electronic apparatus including the electro-optical display device.

2. Related Art

For reducing cost of an electro-optical panel using an active matrix device, there has been known a technique of providing a drive circuit on the same substrate as that of the active matrix device. In particular, if the drive circuit is configured only with transistors of the same conductivity type that is either an n-type or a p-type, then an effect of reducing the cost of the electro-optical panel is increased. In this case, a configuration with a scanner using a bootstrap as a scan line drive circuit is typically proposed in order to sufficiently obtain a potential amplitude of an output signal of the drive circuit, and many similar configurations have been proposed. Japanese Patent No. 3658349 is an example of the related art.

Note that, when a potential (hereinafter, referred to as bootstrap potential) raised by the bootstrap becomes high, a drive capability of the scanner can be increased. However, a too high bootstrap potential leads to element destruction and reliability decrease in the scanner. JP-A-2008-287134 proposes a technology for adequately controlling the bootstrap potential.

In a technique for adjusting the bootstrap potential by such capacitor division as proposed in JP-A-2008-287134, a circuit area is increased owing to an element area of capacitors, and in addition, the technique concerned is weak against variations in manufacturing process.

SUMMARY

An advantage of some aspects of the invention is to provide a scanner including: a plurality of unit circuits configured with transistors of a same conductivity type. In the scanner, the unit circuit constituting the scanner includes an output transistor that selectively outputs, to an output terminal of the unit circuit, a signal given from an outside. A gate electrode of the output transistor is connected to one end of a voltage limiting transistor, and a gate electrode of the voltage limiting transistor is supplied with a first power supply potential.

In the aspect of the invention, as an element of the circuits, the unit circuit constituting the scanner includes at least one of a cutoff switch, a control switch, and a reset switch. The cutoff switch writes a second power supply potential into the gate electrode of the output transistor at appropriate timing to cut off the output transistor. The control switch turns to a conductive state at timing when the output transistor turns to a conductive state and writes the second power supply potential into one end thereof. The reset switch writes the second power supply potential into the gate electrode of the output transistor at least immediately after a power supply is turned on. These transistors are connected to an end of the voltage limiting transistor, which is other than the above-described one end thereof.

With such a configuration, the bootstrap potential applied to the gate electrode of the output transistor rises sufficiently, and the drive capability can be ensured. The potential of the other end of the voltage limiting transistor is limited to the first power supply potential. Accordingly, the potentials applied to the elements (to be more specific, the above-described cutoff transistor, control transistor and reset transistor) which constitute each circuit can be limited, preventing the reliability and yield of the scanner from being affected. Moreover, the capacitor for dropping the bootstrap potential is unnecessary, and accordingly, the circuit area can also be reduced.

An advantage of another aspect of the invention is to propose: an electro-optical panel in which such a scanner is formed as a scan line drive circuit on a substrate; and an electro-optical display device and an electronic apparatus, each using the electro-optical panel. It is possible to realize a display device and an electronic apparatus, in which display quality is high since a sufficient capability is provided in the scan line drive circuit, and cost and size are suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplified embodiments of the invention are described using appended drawings.

Embodiments

Figure 1:
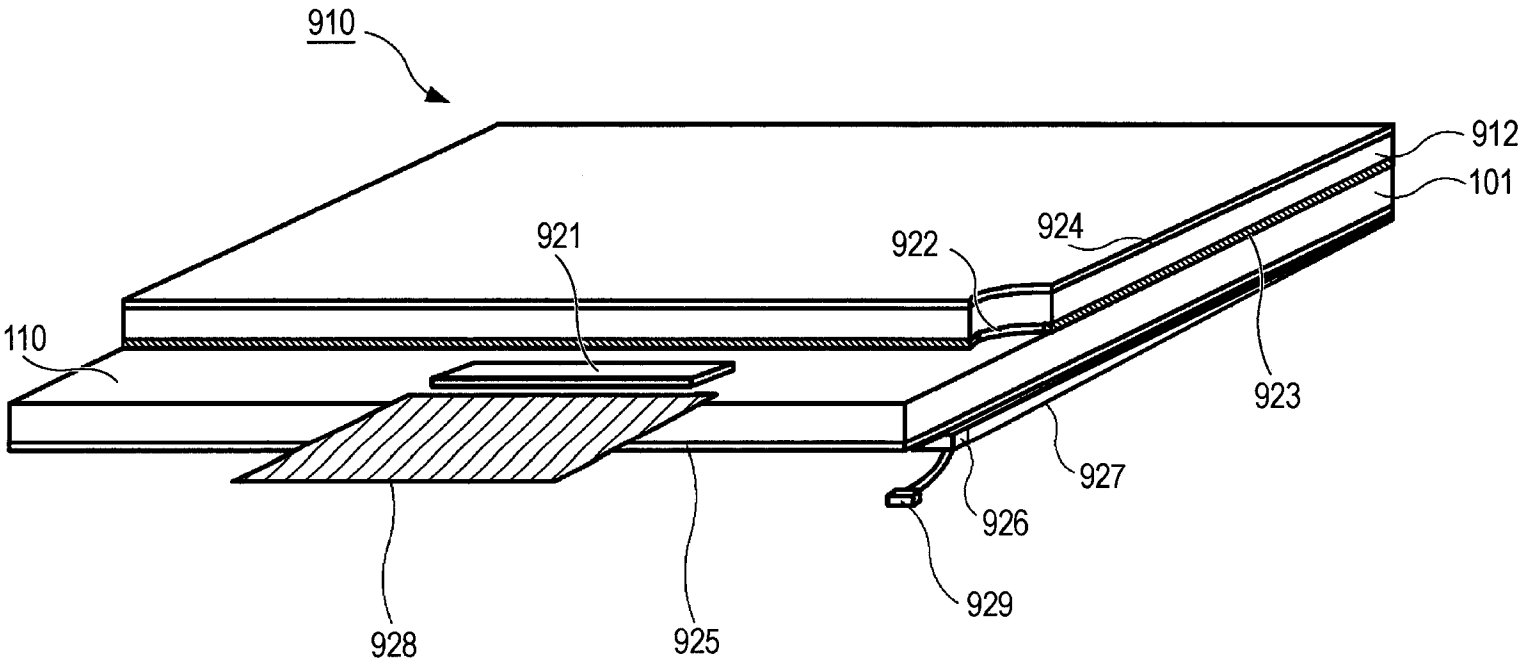
FIG. 1 is a perspective view of a liquid crystal display device according to an embodiment of the invention.

FIG. 1 is a (partially cross-sectional) perspective view of a liquid crystal display device 910 as an electro-optical panel according to an embodiment of the invention. The liquid crystal display device 910 is formed in such a manner that an active matrix substrate 101 as an active matrix device and an opposite substrate 912 are bonded to each other by a seal member 923 so as to be spaced from each other at a fixed interval, and that a nematic-phase liquid crystal material 922 is sandwiched therebetween. On the active matrix substrate 101, though not illustrated, an alignment material made of polyimide or the like is coated, and is subjected to rubbing treatment, whereby an alignment film is formed. On the opposite substrate 912, though not illustrated, color filters and a black matrix are formed. The color filters correspond to pixels, and the black matrix is made of resin with low reflectivity and low transmissibility, which is prepared for preventing light leakage and enhancing a contrast. On a surface of the opposite substrate 912, which contacts with the nematic-phase liquid crystal material 922, an alignment material made of the polyimide or the like is coated, and is subjected to the rubbing treatment in parallel and reverse to a direction of the rubbing treatment of the alignment film for the active matrix substrate 101.

An upper polarization plate 924 is arranged on the outside of the opposite substrate 912, a lower polarization plate 925 is arranged on the outside of the active matrix substrate 101. The upper and lower polarization plates 924 and 925 are arranged so that polarization directions thereof can be perpendicular to each other (crossed-Nicols state). A backlight unit 926 and a light guide plate 927 are arranged under the lower polarization plate 925. The light guide plate 927 is irradiated with light from the backlight unit 926, and reflects and refracts the light directed from the backlight unit 926 so that the light can become a surface light source that is vertical and even toward the active matrix substrate 101. Accordingly, the backlight unit 926 and the light guide plate 927 function as a light source of the liquid crystal display device 910. In this embodiment, the backlight unit 926 is an LED unit, however, it may be a cold cathode fluorescent lamp (CCFL). The backlight unit 926 is connected to a main unit of an electronic apparatus 1000 (refer to FIG. 4) through a connector 929, and is supplied with power therefrom. Though not illustrated, if needed, the liquid crystal display device 910 may be further covered with an outer shell, or a glass or acrylic plate for protection may be further attached onto the upper polarization plate 924, or an optical compensation film may be further bonded thereonto in order to improve a viewing angle.

In the active matrix substrate 101, an extended portion 110 that extends from the opposite substrate 912 is provided. On the extended portion 110, an FPC 928 as a flexible board and a drive IC 921 are packaged, and are electrically connected to each other through signal input terminals 320 (refer to FIG. 2) provided on the extended portion 110. The drive IC 921 supplies a signal and power, which are necessary for drive of the active matrix substrate 101, to the active matrix substrate 101. The FPC 928 supplies a necessary signal and power to the drive IC 921 and the active matrix substrate 101 from an external power supply circuit 784 and a video processing circuit 780 (refer to FIG. 4) which constitute the electronic apparatus 1000. Note that chip-on-glass (COG) packaging in which the drive IC 921 is packaged on the extended portion 110 is adopted in this embodiment; however, chip-on-film (COF) packaging may be adopted, in which the FPC 928 alone is packaged on the extended portion 110, and the drive IC 921 is packaged on the FPC 928.

Figure 2:
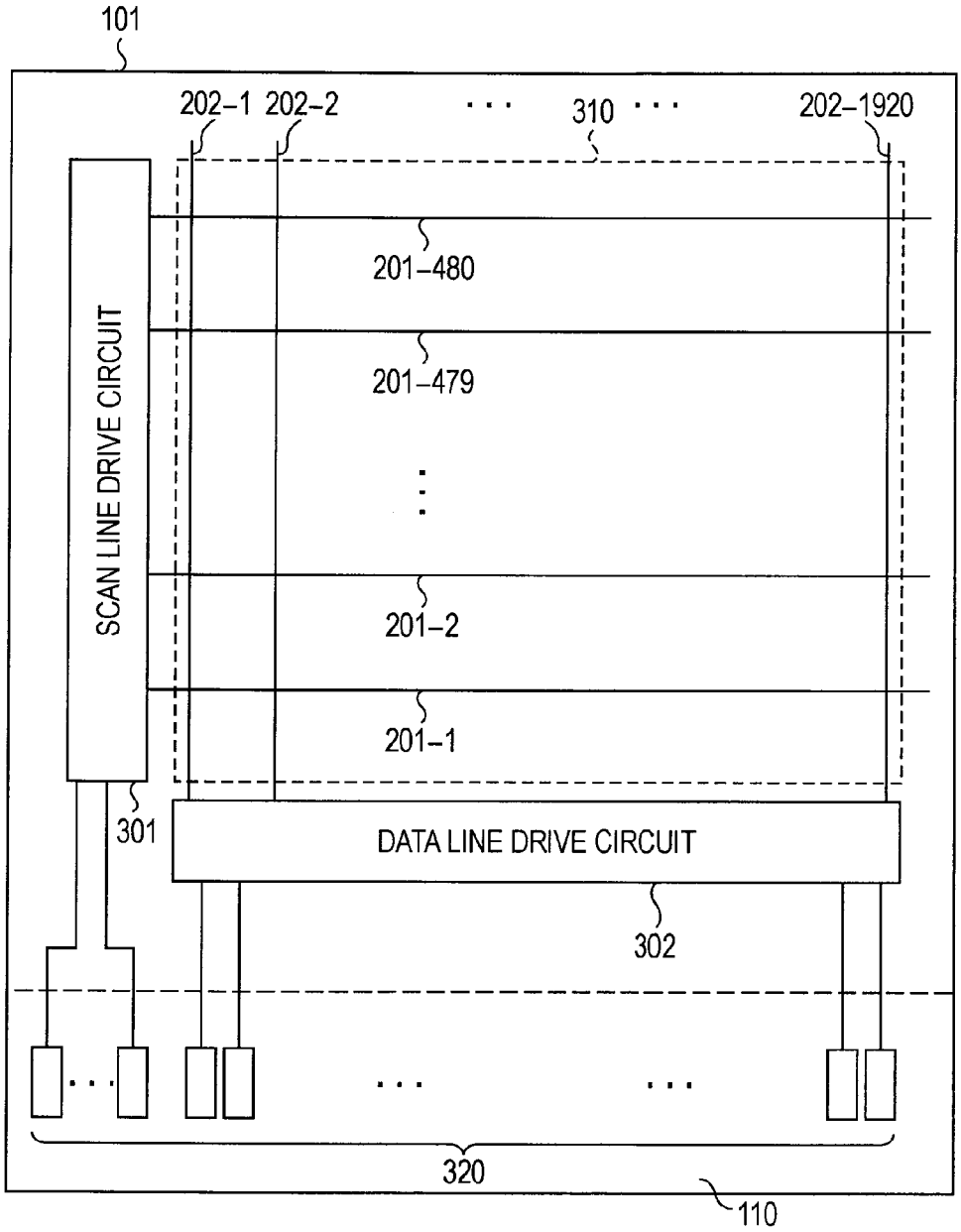
FIG. 2 is a diagram illustrating the configuration of an active matrix substrate according to an embodiment of the invention.

FIG. 2 is a diagram illustrating the configuration of the active matrix substrate 101. On the active matrix substrate 101, a plurality (480) of scan lines 201 (201-1 to 201-480) and a plurality (1920) of data lines 202 (202-1-202-1920) are formed perpendicularly intersecting to each other. The scan lines 201-1 to 201-480 are connected to and driven by a scan line drive circuit 301. The data lines 202-1 to 202-1920 are connected to and driven by a data line drive circuit 302. Note that the active matrix substrate 101 is an active matrix substrate of a so-called drive circuit built-in type, in which thin film transistors constituting the scan line drive circuit 301 and the data line drive circuit 302 are manufactured in the same manufacturing process as that for pixel switching elements 401 (401-*n*-*m*) to be described later.

Figure 3:
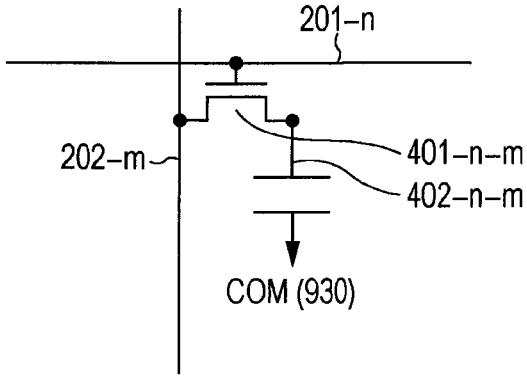
FIG. 3 is a pixel circuit diagram of the active matrix substrate according to an embodiment of the invention.

FIG. 3 is a circuit diagram of a vicinity of an intersection of an m-th data line 202-*m* and an n-th scan line 201-*n* on a display area 310. The liquid crystal display device 910 as the electro-optical panel includes a plurality of the pixel switching elements connected to the plurality of scan lines and arranged in a matrix fashion. On the intersection of the scan line 201-*n* and the data line 202-*m*, a pixel switching element 401-*n*-*m* formed of an re-channel field effect polysilicon thin film transistor is formed. A gate electrode of the pixel switching element 401-*n*-*m* is connected to the scan line 201-*n*, and source and drain electrodes thereof are connected to the data line 202-*m* and a pixel electrode 402 (402-*n*-*m*), respectively. The pixel electrode 402-*n*-*m* forms an auxiliary capacitor by sandwiching a dielectric with a common electrode (COM) 930. Further, when the pixel electrode 402-*n*-*m* is assembled as a component of the liquid crystal display device, the pixel electrode 402-*n*-*m* also forms a capacitor by sandwiching a liquid crystal element with the common electrode (COM) 930. Note that the common electrode (COM) 930 is a transparent common electrode arranged on the entirety of the display area 310 on the active matrix substrate 101. The common electrode (COM) 930 forms a capacitor on the active matrix substrate 101 together with each pixel electrode 402-*n*-*m*, and is configured so as to form a liquid crystal display device of a so-called in-plane-switching (IPS) mode in which an electric field is applied in a direction parallel to the active matrix substrate 101. In the embodiment, the common electrode (COM) 930 is subjected to AC drive in which a polarity of a potential is inverted in a fixed cycle; however, may be subjected to DC drive in which a constant potential is always maintained.

Figure 4:
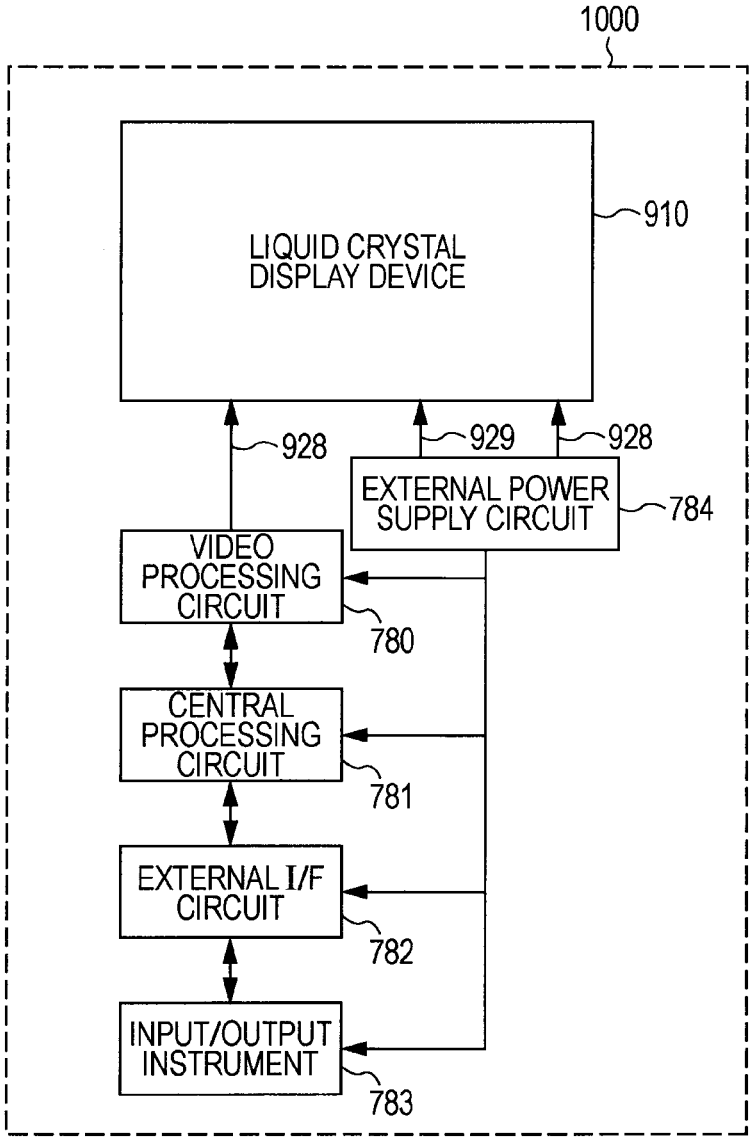
FIG. 4 is a block diagram illustrating an embodiment of an electronic apparatus of the invention.

FIG. 4 is a block diagram illustrating a specific configuration of the electronic apparatus 1000 in this embodiment. The liquid crystal display device 910 is the liquid crystal display device described with reference to FIG. 1. The external power supply circuit 784 and the video processing circuit 780 supply the liquid crystal display device 910 with the necessary signal and power through the FPC 928 and the connector 929. A central processing circuit 781 acquires input data from an input/output instrument 783 through an external I/F circuit 782. For example, the input/output instrument 783 may be a keyboard, a mouse, a trackball, an LED, a speaker, an antenna or the like. Using such external data, the central processing circuit 781 performs a variety of operations, and transfers the result thereof as a command to the video processing circuit 780 or the external I/F circuit 782. The video processing circuit 780 updates video information on the basis of the command from the central processing circuit 781, and changes the signal for the liquid crystal display device 910, whereby video to be displayed on the liquid crystal display device 910 is changed. Note that, to be more specific, the electronic apparatus 1000 may be a monitor, a television set, a notebook personal computer, a PDA, a digital camera, a video camera, a cellular phone, a video player, a DVD player, an audio player or the like. Moreover, in a similar way, the embodiment can also be applied to a variety of electro-optical display devices using the liquid crystal display device 910 that is the electro-optical panel. Furthermore, this invention can also be applied to other electronic apparatuses including the liquid crystal display device 910 that is the electro-optical panel of this invention.

Figure 5:
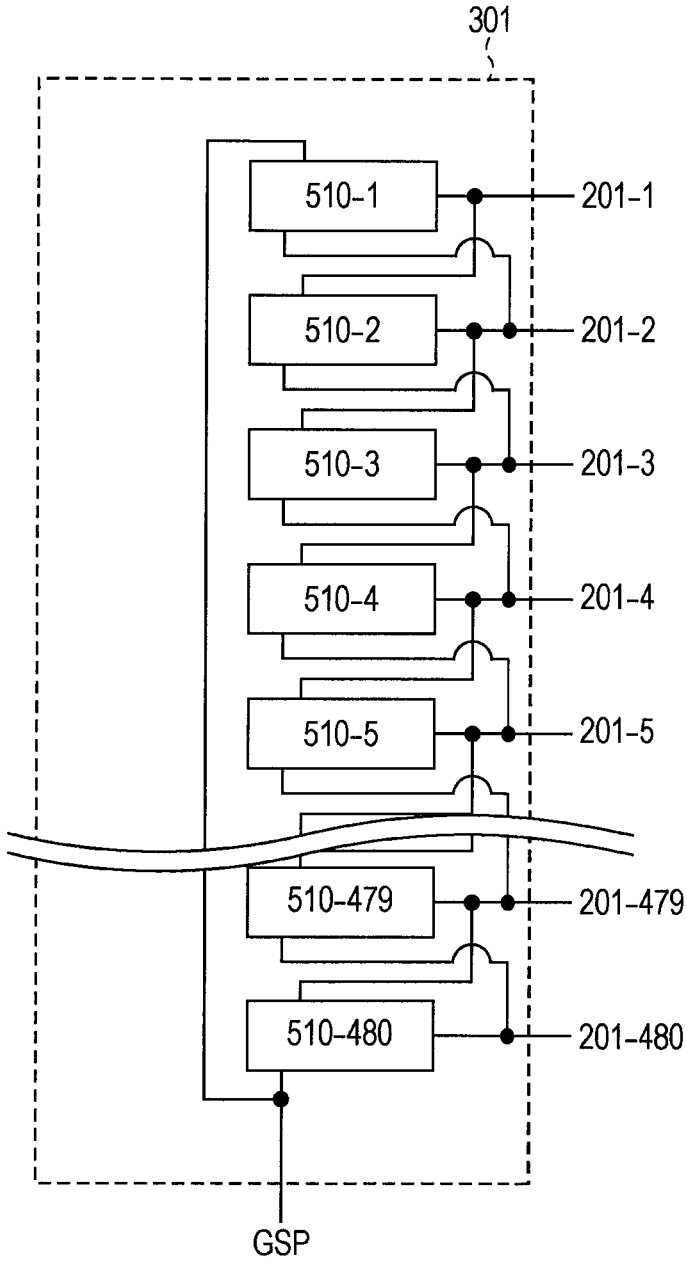
FIG. 5 is a block diagram illustrating an embodiment of a scan line drive circuit of the invention.

FIG. 5 is a block diagram of the scan line drive circuit 301 as a scanner in a first embodiment. The scan line drive circuit 301 is configured with unit scan line drive circuits 510-1 to 510-480 as 480 unit circuits configured with transistors of the same conductivity type, and an output terminal of the unit scan line drive circuit 510-*n* is connected to the scan line 201-*n* (n=1 to 480). The unit scan line drive circuit 510-*n* is also connected to the scan line 201-*n*−1 and the scan line 201-*n*+1. The unit scan line drive circuit 510-1 and the unit scan line drive circuit 510-480 are connected to a signal GSP. The unit scan line drive circuits 510-1 to 510-480 as a plurality of unit circuits which constitute the scan line drive circuit 301 as the scanner include first transistors 411 as output transistors selectively outputting signals, which are given from the outside, to output terminals of a plurality of unit circuits.

Figure 6:
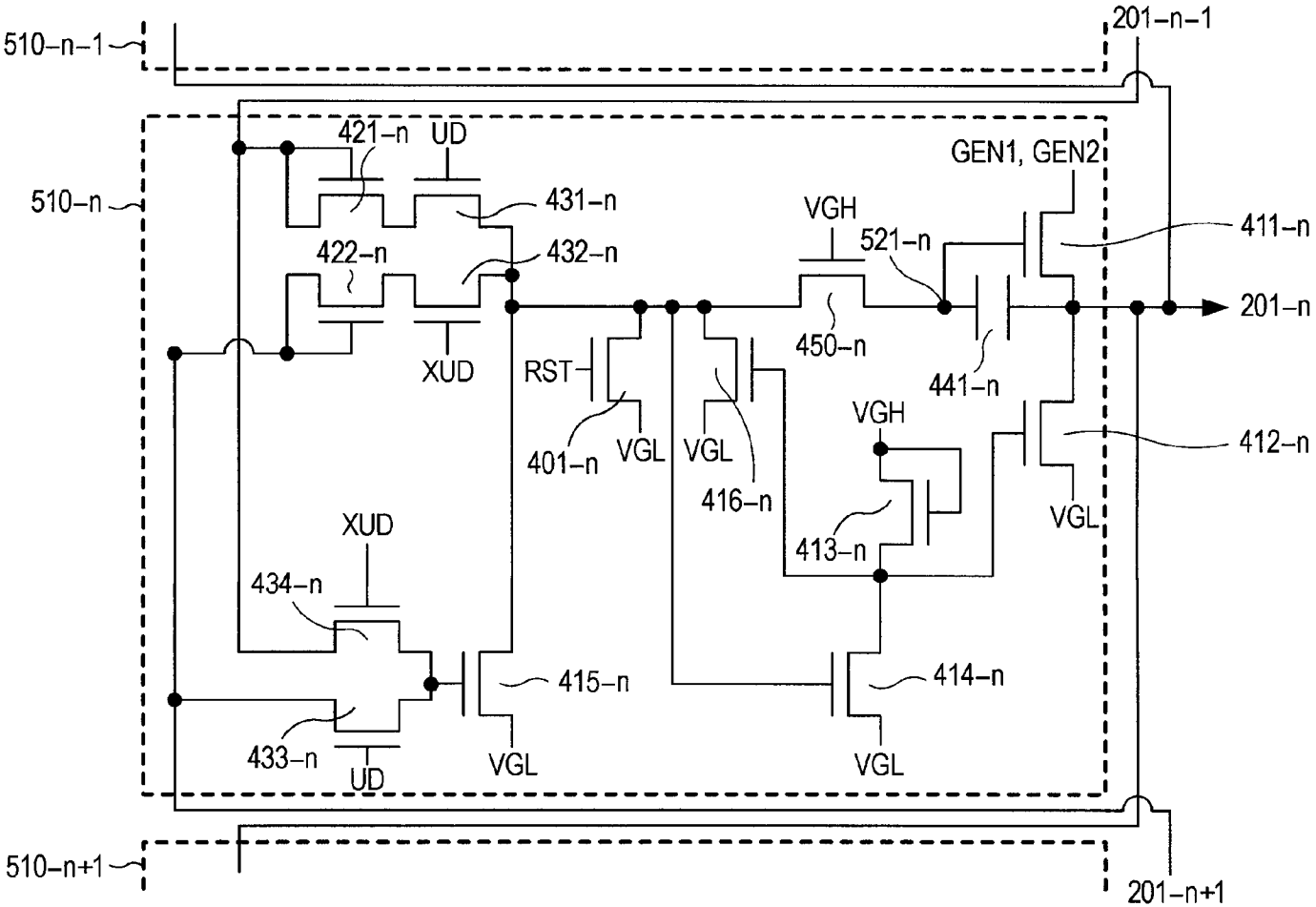
FIG. 6 is a circuit diagram illustrating an embodiment of a unit scan line drive circuit of the invention.

FIG. 6 is a circuit diagram of an n-th (n=1 to 480) unit scan line drive circuit 501-*n*. To the n-th scan line 201-*n*, there are connected: one end of the first transistor 411-*n* as the output transistor; one end of a second transistor 412-*n*; and one end of a first capacitor 441-*n*. To the other end of the first transistor 411-*n* as the output transistor, a signal GEN1 (in the case where n is odd) or a signal GEN2 (in the case where n is even) is connected. A gate electrode of the first transistor 411-*n* as the output transistor is connected to a bootstrap node 521-*n*, and is connected to the other end of the first capacitor 441-*n* and one end of a voltage limiting transistor 450-*n*. The other end of the voltage limiting transistor 450-*n* is connected to one end of a first direction switch 431-*n*, one end of a second direction switch 432-*n*, one end of a fifth transistor 415-*n* as a cutoff switch, one end of a reset switch 401-*n*, one end of a sixth transistor 416-*n*, and a gate electrode of a fourth transistor 414-*n* as a control switch. A gate electrode of the second transistor 412-*n* is connected to one end of a third transistor 413-*n*, one end of the fourth transistor 414-*n* as the control switch, and a gate electrode of the sixth transistor 416-*n*. A gate electrode of the fifth transistor 415-*n* as the cutoff switch is connected to one end of a third direction switch 433-*n* and one end of a fourth direction switch 434-*n*. Gate electrodes of the first direction switch 431-*n* and the third direction switch 433-*n* are supplied with a first direction signal UD. Gate electrodes of the second direction switch 432-*n* and the fourth direction switch 434-*n* are supplied with a second direction signal XUD. The other end of the first direction switch 431-*n* is connected to one end of a first rectifying element 421-*n*. The other end of the second direction switch 432-*n* is connected to a second rectifying element 422-*n*. The other end and gate electrode of the first rectifying element 421-*n* and the other end of the fourth direction switch 431-*n* are connected to the scan line 201-*n*−1 on the previous stage (in the case of n=2 to 480) or the signal GSP (in the case of n=1). The other end and gate electrode of the second rectifying element 422-*n* and the other end of the third direction switch 433-*n* are connected to the scan line 201-*n*+1 on the next stage (in the case of n=1 to 479) or the signal GSP (in the case of n=480).

The other end and gate electrode of the third transistor 413-*n* are connected to a potential VGH as a first power supply potential. The respective other ends of the second transistor 412-*n*, the fourth transistor 414-*n* as the control switch, the fifth transistor 415-*n* as the cutoff switch, the sixth transistor 416-*n* and the reset switch 401-*n* are connected to a potential VGL as a second power supply potential. The gate electrode of the reset switch 401-*n* is connected to a signal RST.

The gate electrode of the first transistor 411-*n* as the output transistor is connected to one end of the voltage limiting transistor 450-*n*. A gate electrode of the voltage limiting transistor 450-*n* is supplied with the potential VGH as the first power supply potential.

Note that the signal GEN1, the signal GEN2, the signal GSP and the signal RST, which are signals given from the outside, are timing signals supplied from the drive IC 921 through the signal input terminal 320 at an amplitude of 0 V/+15 V. The potential VGH as the first power supply potential and the potential VGL as the second power supply potential are DC power inputted from the drive IC 921 through the signal input terminal 320. The potential VGH as the first power supply potential is set at 15 V, and the potential VGL as the second power supply potential is set at 0V. The first direction signal UD and the second direction signal XUD are potentials inputted from the drive IC 921 through the signal input terminal 320, and are set at a DC potential of 15 V or 0 V in response to a scanning direction (described later). Each of the first transistor 411-*n*, the second transistor 412-*n*, the third transistor 413-*n*, the fourth transistor 414-*n*, the fifth transistor 415-*n*, the sixth transistor 416-*n*, the first direction switch 431-*n*, the second direction switch 432-*n*, the third direction switch 433-*n*, the fourth direction switch 434-*n*, the first rectifying element 421-*n*, the second rectifying element 422-*n* and the reset switch 401-*n* is configured with the re-channel field effect polysilicon thin film transistor, and is formed on the active matrix substrate 101 in the same process as that for the pixel switching element 401-*n*-*m*. These transistors are manufactured in the same process, and accordingly, have substantially the same characteristics. In this embodiment, a threshold voltage Vth of the transistors is set at +2 V. The first capacitor 441-*n* is provided in order to obtain a stable bootstrap voltage in this embodiment; however, is unnecessary depending on design parameters of the transistors. The sixth transistor 416-*n* is provided in order to continue to fix a gate voltage of the first transistor 411-*n* as the output transistor at 0 V during a non-selection period; however, is unnecessary depending on the design parameters, either.

Figure 7:
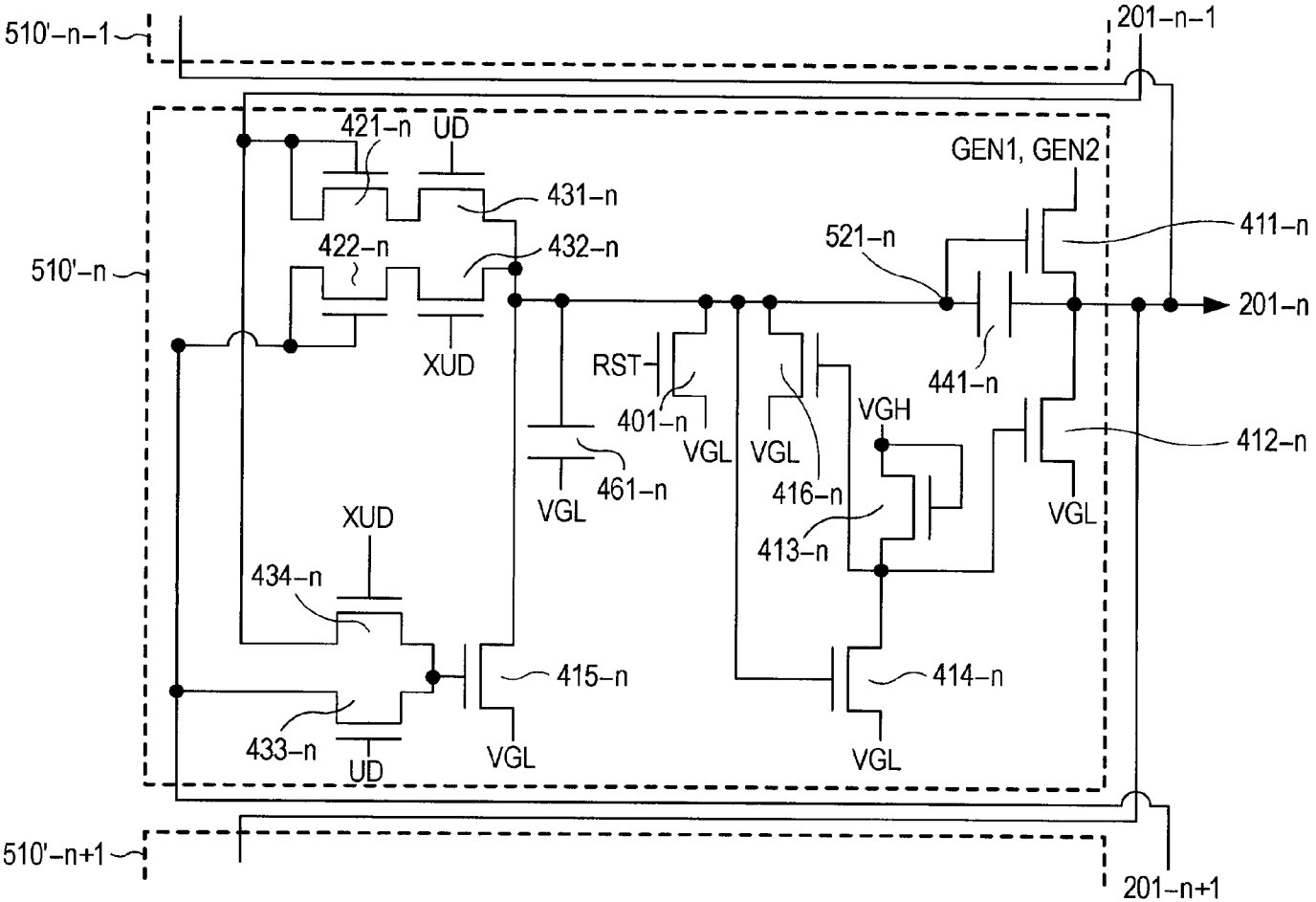
FIG. 7 is a circuit diagram of a unit scan line drive circuit according to a comparative example for explaining the invention.

FIG. 7 is a circuit diagram of a unit scan line drive circuit 510'-*n* illustrated as a comparative example of FIG. 6. In the comparative example, the voltage limiting transistor 450-*n* does not exist. To the bootstrap node 521-*n*, there are directly connected: one end of the first direction switch 431-*n*; one end of the second direction switch 432-*n*; one end of the fifth transistor 415-*n* as the cutoff switch; one end of the reset switch 401-*n*; one end of the sixth transistor 416-*n*; and a gate electrode of the fourth transistor 414-*n* as the control switch. Moreover, a voltage absorbing capacitor 461-*n* is added, one end thereof is connected to the bootstrap node 521-*n*, and the other end thereof is connected to the potential VGL. Other configurations are the same as those in FIG. 6, and accordingly, a description thereof will be omitted by assigning the same reference numerals thereto.

Figure 8:
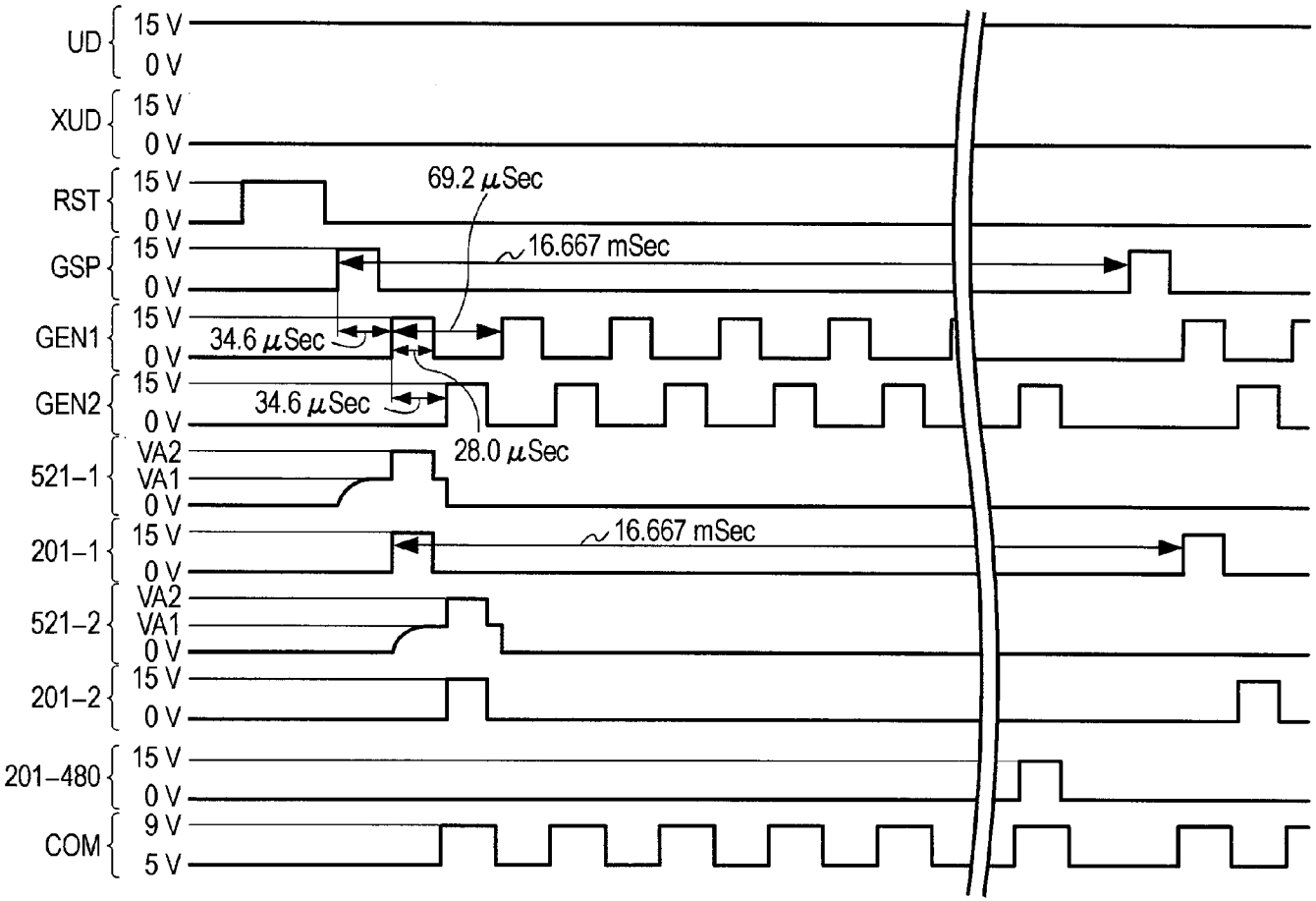
FIG. 8 is a timing chart for explaining forward operations of the scan line drive circuit according to an embodiment of the invention.

FIG. 8 is a timing chart at the time of forward operations of the scan line drive circuit 301. Not that whether the scan drive circuit 301 is in the forward operations or reverse operations is determined by the central processing circuit 781 in FIG. 4, and a setting command is sent to the drive IC 921 through the video processing circuit 780 and the FPC 928 as a flexible board. At the time of the forward operations, a DC potential of 15 V is given to the first direction signal UD from the drive IC 921, and a DC potential of 0 V is given to the second direction signal XUD from the drive IC 921. Accordingly, the first direction switch 431-*n* and the third direction switch 433-*n* are always in a conductive state, and the second direction switch 432-*n* and the fourth direction switch 434-*n* are always in a non-conductive state. The signal RST is a reset signal that turns to High (15 V) for 40 microseconds only once before the first signal GSP turns to High (15 V) after the power supply is activated. The signal GSP is a signal that turns to High for 28 microseconds once in a 16.667 millisecond cycle (frame cycle). The signal GEN1 is a signal that turns to High (15 V)

after elapse of 34.6 microseconds after the signal GSP turns to High, and thereafter, repeats a cycle of turning to High (15 V) for 28 microseconds at every 69.2 microseconds 240 times. The signal GEN2 is a signal that is similar to the signal GEN1 and is delayed in phase therefrom by 34.6 microseconds.

First, when the signal RST turns to High (=15 V) for a fixed time (40 microseconds in this embodiment), the reset switches 401 in all the stages are turned on, the bootstrap nodes 521 are charged with the potential VGL (0 V) through the voltage limiting transistors 450, and the gate electrodes of the fourth transistors 414 as the control switches are also charged with the potential VGL (0 V). Accordingly, the gate electrodes of the second transistors 412 are charged with a potential (13 V), in which the potential VGH (15 V) is dropped by the threshold voltage Vth (=2 V), through the third transistors 413. Then, the first transistors 411 as the output transistors are turned off, and the second transistors 412 are turned on. Accordingly, all the scan lines 201-1 to 201-480 are charged with the potential VGL (0 V). Note that the reset operation is performed only once immediately after the power supply is turned on in this embodiment; however, may be performed every time for each vertical blank period.

Next, when the signal GSP turns to High (=15 V), the first rectifying element 421-1 on the first stage (n=1) is turned on, and the bootstrap node 521-1 is charged through the first direction switch 431-1 and the voltage limiting transistor 450-1. At this time, a potential applied from the first rectifying element 421-1 to the first direction switch 431-1 is decreased by an amount of the threshold voltage Vth (Vth=2 V), and becomes 13 V. However, gate potentials of the first direction switch 431-1 and the voltage limiting transistor 450-1 are 15 V, and become just equal to the sum of the applied voltage (13 V) and the threshold voltage (2 V). Accordingly, a potential drop owing to the first direction switch 431-1 and the voltage limiting transistor 450-1 hardly occurs, a potential of the bootstrap node 521-1 becomes VA1 (=13 V), and the first transistor 411-1 as the output transistor turns to the conductive state. At this time, a potential of the gate electrode of the fourth transistor 414-1 as the control switch becomes VA1 (=13 V), then the fourth transistor 414-1 as the control switch turns to the conductive state, and writes the potential VGL (0 V) into the gate electrodes of the second transistor 412-1 and the sixth transistor 416-1 to make them turn to the non-conductive state.

Since the first rectifying element 421-1 is turned off when the signal GSP turns to Low (=0 V), the bootstrap node 521-1 maintains 13 V. Next, when the signal GEN1 is inverted to High (=15 V), the potential of the bootstrap node 521-1 rises by 15 V if the sum of a capacitance of the first capacitor 441-1 and a gate capacitance of the first transistor 411-1 is sufficiently larger than a parallel capacitance and crossing capacitance of wiring, and then the potential becomes VA2 (=28 V). However, the gate potential of the voltage limiting transistor 450-1 is 15 V, and the threshold voltage thereof is 2 V, and accordingly, the voltage limiting transistor 450-1 turns to the non-conductive state when the source potential thereof becomes 13 V or more. Then, potentials of one end of the first direction switch 431-1, one end of the second direction switch 432-1, one end of the fifth transistor 415-1 as the cutoff switch, one end of the reset switch 401-1, one end of the sixth transistor 416-1 and the gate electrode of the fourth transistor 414-1 as the control switch do not rise to 13 V or more. Moreover, each of a source potential and drain potential of the first transistor 411-1 is approximately 15 V, and accordingly, a potential difference thereof from the bootstrap node 521-1 connected to the gate electrode thereof is 13 V. Furthermore, the gate potential of the voltage limiting transistor 450-1 is 15 V, and the source potential thereof is 13 V, and accordingly, potential differences thereof from the bootstrap node 521-1 are 13 V and 15 V, respectively. As described above, the potential as large as 28 V is applied to the bootstrap node 521-1, whereby a drive capability of the output transistor can be ensured sufficiently, and meanwhile, the difference between the potentials applied to the respective elements is 15 V maximum, and there is no apprehension that element destruction, malfunction owing to characteristic variations, and the like occur.

Next, when the signal GEN1 turns to Low (=0 V) after elapse of 28 microseconds, a potential of the scan line 201-1 also returns to 0 V. At this time, the potential of the bootstrap node 521-1 also returns to the potential VA1 (=13 V), and accordingly, the potential difference of 15 V or more is not applied to the first transistor 411-1 as the output transistor.

On the next stage (n=2), at timing when the signal GEN1 is inverted to High (=15 V), and the potential of the scan line 201-1 turns to 15 V, the first rectifying element 421-2 is turned on, and the bootstrap node 521-2 is charged with the potential VA1 (=13 V) through the first direction switch 431-2. When the signal GEN2 is inverted to High (=15 V) after elapse of 6.6 microseconds since the signal GEN1 turns to Low (=0 V), the bootstrap node 521-2 is strapped to the potential VA2 (=28 V), and 15 V is written into the scan line 201-2. At this time, the fifth transistor 415-1 as the cutoff switch on the first stage turns to the conductive state, and the bootstrap node 521-1 turns to the potential VGL (0 V). Then, the first transistor 411-1 and the fourth transistor 414-1 turn to the non-conductive state. The potential 13 V is written into the gate electrode of the second transistor 412-1 and the gate electrode of the fifth transistor 415-1, and the second transistor 412-1 and the fifth transistor 415-1 turn to the conductive state. The scan line 201-1 conducts to the potential VGL (0 V), and the signal GEN1 and the scan line 201-1 are cut off from each other until the next frame. In a similar way in the following, the scan line **201-*n* is sequentially selected in order of n=1, 2, 3, 4, 5, and so on. One of the unit scan line drive circuits 510-1 to 510-480 as the plurality of unit circuits includes the fifth transistor 415-*n* as the cutoff switch, turns to the conductive state by the output signal from one of the unit scan line drive circuits 510-1 to 510-480 as the other plurality of unit circuits, and writes the potential VGL as the second power supply potential into the gate electrode of the first transistor 411-*n* as the output transistor, thereby functioning to cut off the first transistor 411-*n*** as the output transistor.

Figure 9:
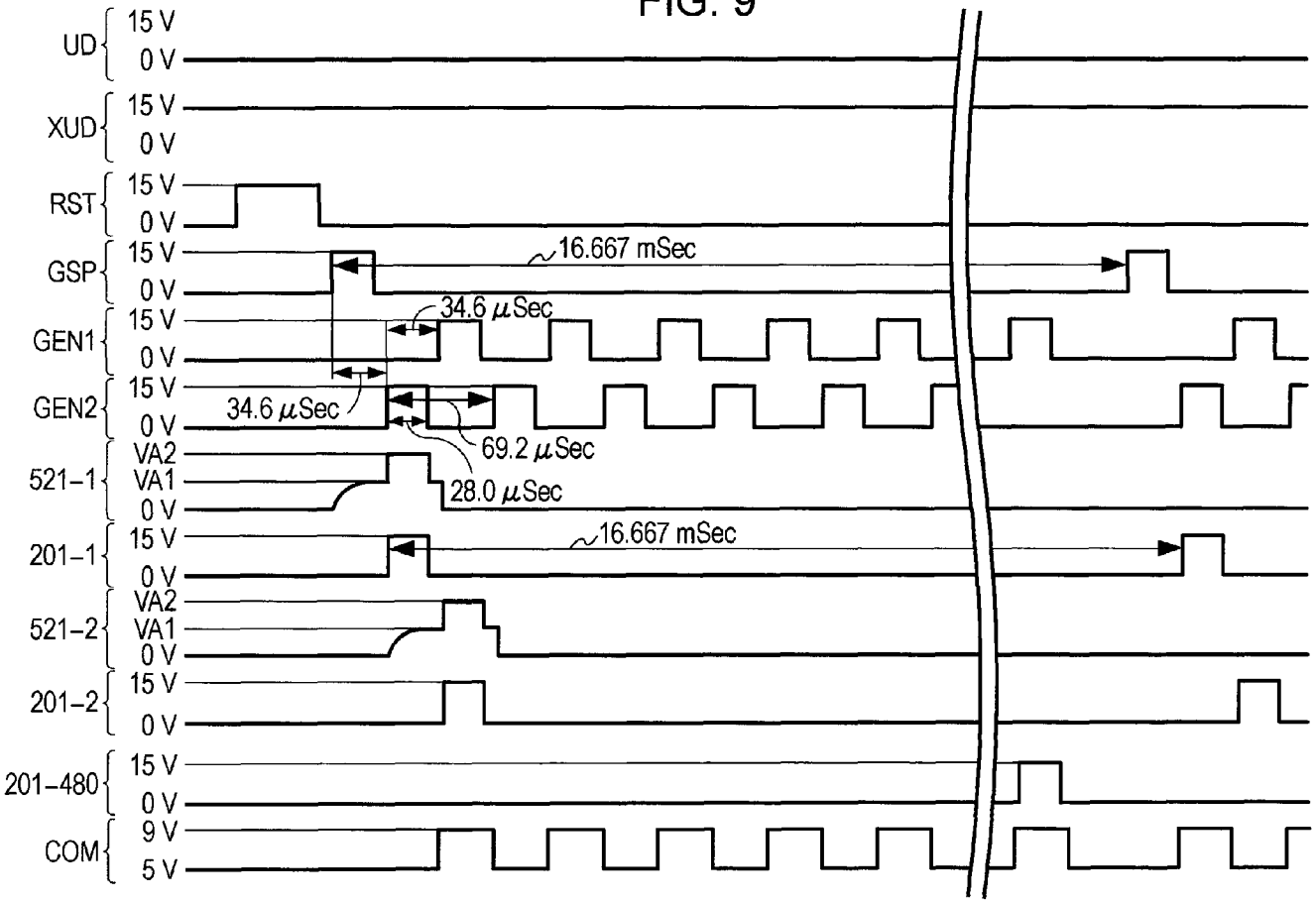
FIG. 9 is a timing chart for explaining reverse operations of the scan line drive circuit according to an embodiment of the invention.

FIG. 9 is a timing chart at the time of the reverse operations of the scan line drive circuit 301. At the time of the reverse operations, a DC potential of 0 V is given to the first direction signal UD, and a DC potential of 15 V is given to the second direction signal XUD. Accordingly, the first direction switch **431-*n* and the third direction switch 433-*n* are always in the non-conductive state, and the second direction switch 432-*n* and the fourth direction switch 434-*n* are always in the conductive state. The signal GEN2 and the signal GEN1 interchange with each other from those in FIG. 8, and the signal GEN1 is a signal that is similar to the signal GEN2 and is delayed in phase therefrom by 34.6 microseconds; however, except for this, similar timing signals to those in FIG. 8 are inputted. When the signal GSP turns to High (=15 V), the first rectifying element 421-480 on the final stage (n=480) is turned on, and a potential of the bootstrap node 521-480 becomes VA1 (=13 V). Next, when the signal GEN2 is inverted to High (=15 V), the potential of the bootstrap node 521-480 becomes VA2 (=28 V), and 15 V is written in to the scan line 201-480. At this time, the first rectifying element 421-479 on the previous stage (n=479) is turned on, and the bootstrap node 521-479 is charged with the potential VA1 (=13 V) through the first direction switch 431-479. In a similar way in the following, the scan line 201**-*n* is sequentially selected in order of n=480, 479, 478, 477, 476 . . . . Such reverse scanning is completely similar to the forward scanning in FIG. 8 except that the scan line 201-*n* is selected in the reverse direction.

In the configuration of the comparative example illustrated in FIG. 7, the voltage absorbing capacitor 461-*n* is connected to the bootstrap node 521-*n*. Procedures up to the charge of the bootstrap node 521-*n* with the potential VA1 (=13 V) in the comparative example are the same as those in the embodiment. However, the potential VA2 at the time when the signal GEN1 or the signal GEN2 is inverted to High (=15 V) and the bootstrap node 521-*n* is strapped is determined by a ratio of a capacitance value C1 as the sum of the capacitance of the first capacitor 441-*n* and the gate capacitance of the first transistor 411-*n* and a capacitance value C2 of the voltage absorbing capacitor 461-*n*. In this embodiment, the capacitance value C1 is equal to 500 fF, the capacitance value C2 is equal to 500 fF, and at this time, the potential VA2 becomes equal to 22.5 V. The potential VA2 (=22.5 V) is also applied to one end of the first direction switch 431-*n*, one end of the second direction switch 432-*n*, one end of the fifth transistor 415-*n* as the cutoff switch, one end of the reset switch 401-*n*, one end of the sixth transistor 416-*n*, and the gate electrode of the fourth transistor 414-*n* as the control switch.

As described above, comparing the configuration of the comparative example in FIG. 7, in which the potential VA2 as the bootstrap potential of the bootstrap node 521-*n* is dropped by using the voltage absorbing capacitor, in the embodiment (configuration of FIG. 6) of this invention, the gate potential of the first transistor 411-*n* as the output transistor is higher by 6.5 V, and by this amount, a drive capability of the scan line 201-*n* is increased. Accordingly, an element size is reduced, whereby a circuit area is reduced, and power consumption can be reduced. Accordingly, the scanner of this embodiment can also be applied to a panel with a larger size and higher definition. In this embodiment, the maximum difference among the potentials applied to the respective transistors is also lower by 7.5 V, and the scanner of this embodiment can be configured with elements with a lower withstand voltage and reliability, and accordingly manufacturing cost thereof can be reduced. Moreover, the circuit area is reduced since the voltage absorbing capacitor 461-*n* is unnecessary, and the power consumption is further reduced by an amount that is necessary to charge/discharge the voltage absorbing capacitor 461-*n*. Furthermore, in the comparative example, when the capacitance of the voltage absorbing capacitor 461-*n* is reduced more than assumption owing to variations in manufacturing process, the potential VA2 as the bootstrap potential rises, which leads to the element destruction and deterioration of reliability, and accordingly, causes difficulty in manufacturing management and causes a cost increase; however, there are no such problems in this embodiment.

Note that this invention is not limited to the circuit configuration illustrated in FIG. 6, and is applicable to any scanner as long as the scanner straps the potential of the gate electrode of the output transistor by using the bootstrap.

Figure 10:
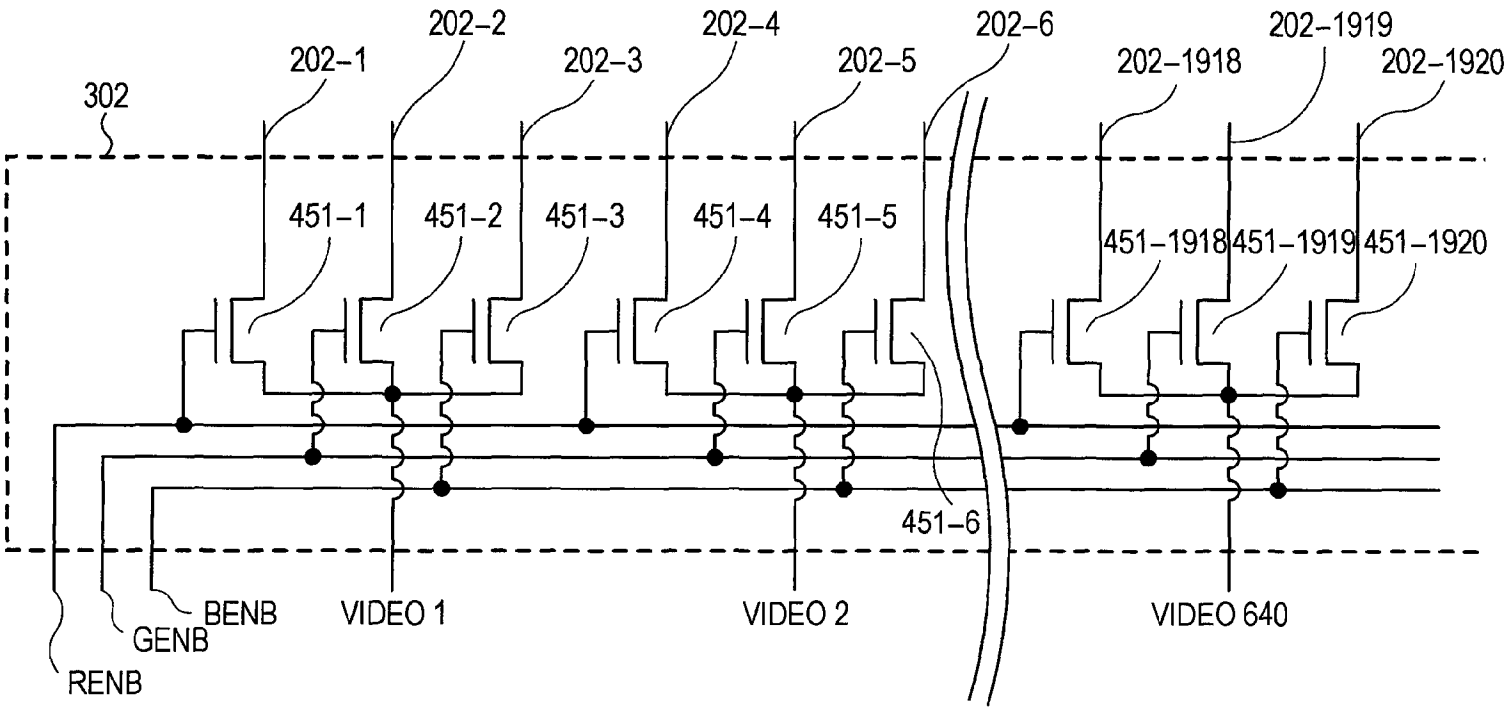
FIG. 10 is a circuit diagram illustrating an embodiment of a data line drive circuit of the invention.

FIG. 10 is a circuit diagram of the data line drive circuit 302, which has a 1:3 demultiplexer circuit configuration. Drain electrodes of data line switches 451-1 to 451-1920 as n-channel type transistors are connected to 1920 data lines 202-1 to 202-1920, respectively. Source electrodes of the data line switches 451-1 to 451-3 are connected to a signal VIDEO1, source electrodes of the data line switches 451-4 to 451-6 are connected to a signal VIDEO2, and in a similar way in the following, source electrodes of the data line switches 451-(*n*×3−2) to 451-(*n*×3) are connected to signals VIDEOn (n=1 to 640). Moreover, gate electrodes of the data line switches 451-1, 451-4, 451-7, . . . , and 451-1918 are connected to a signal RENB, gate electrodes of the data line switches 451-2, 451-5, 451-8, . . . , and 451-1919 are connected to a signal GENE, and gate electrodes of the data line switches 451-3, 451-6, 451-9, . . . , and 451-1920 are connected to a signal BENB.

Figure 11:
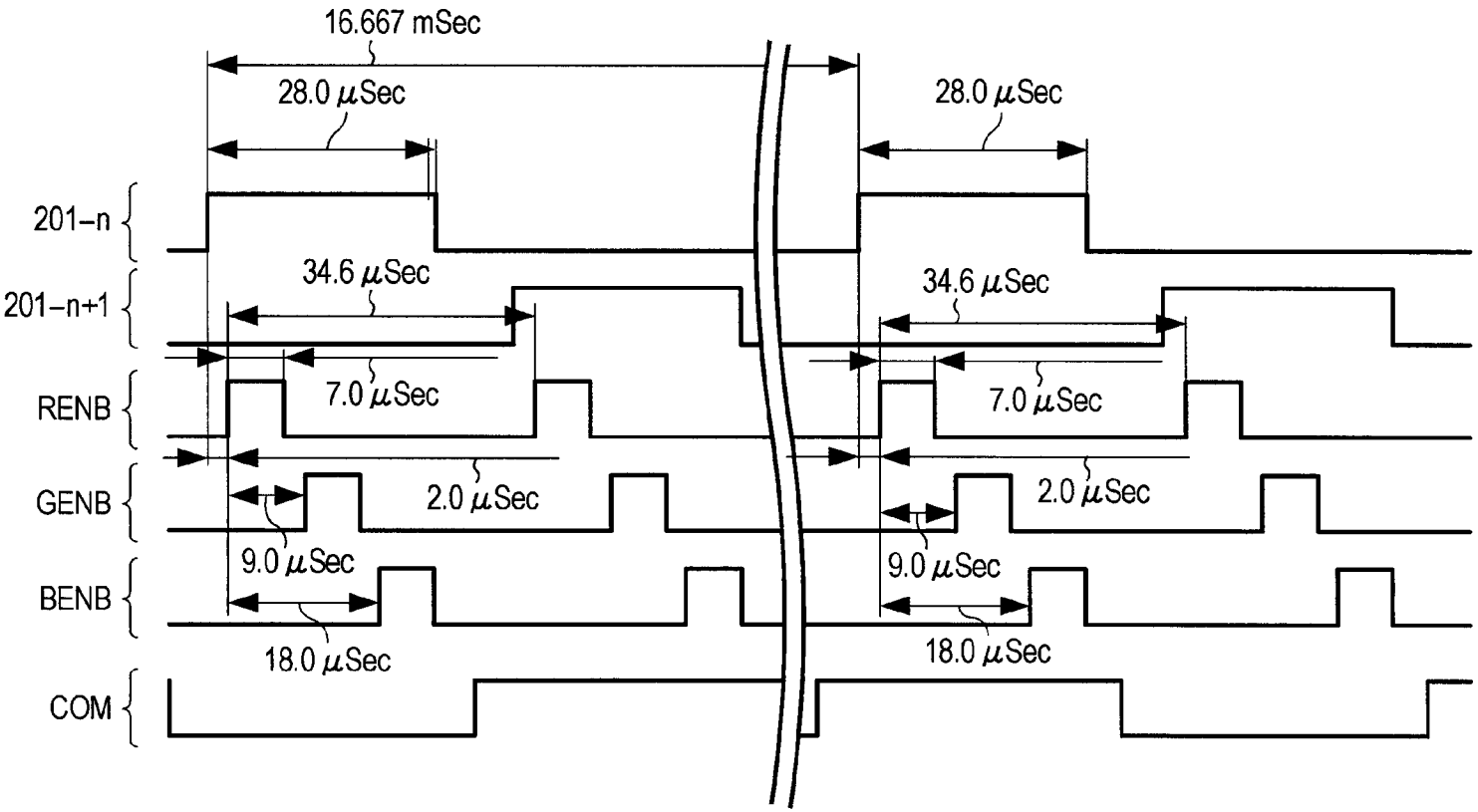
FIG. 11 is a timing chart for explaining operations of the data line drive circuit according to an embodiment of the invention.

FIG. 11 is a timing chart for explaining operations of the data line drive circuit 302. The signal RENB is a signal that turns to High (+15 V) after elapse of 2 microseconds from timing when the scan line 201-*n* (n=1 to 480) is selected (timing when the potential thereof turns to High: +15 V), and returns to Low (0V) after elapse of 7 microseconds from the timing of turning to High. The signal GEMB and the signal BEMB are the same signals as the signal REMB except for being shifted therefrom in phase by 9 microseconds and 18 microseconds, respectively. Note that each of the signal RENB, the signal GEMB and the signal BEMB is an analog potential signal supplied from the drive IC 921 through the signal input terminal 320 at an amplitude of 0 V/+15 V, the signals VIDEO1 to VIDEO640 are analog potential signals of 5 V to 9 V, which are supplied from the drive IC 921 through the signal input terminals 320, and appropriate potentials corresponding to an image are supplied thereto at timing synchronized with the signal RENB, the signal GENB and the signal BENB.

Note that the data line drive circuit in this invention is not limited to the circuit configuration of this embodiment, and for example, it is a matter of course that every known data line drive circuit such as an analog sequential drive circuit and a DAC built-in drive circuit may be used, and the data lines may be directly driven from the drive IC without providing the data line drive circuit.

The scanner of this invention can limit such an element application voltage easily and stably, and is easy to ensure the drive capability. Accordingly, a scanner that is excellent in reliability, is more compact, and consumes less power can be manufactured with good yield and at low cost.

This embodiment is configured with the scanner using the n-channel type transistors; however, it is a matter of course that a similar circuit may be configured with p-channel type transistors by inverting the polarity.

This invention is not limited to the embodiment, and may be used for a liquid crystal display device of a TN mode, a vertical alignment mode (VA mode), or the like. The liquid crystal display device may be not only of the full transmission type but also of a full reflection type and a reflection/transmission combination type. This invention is applicable not only to the liquid crystal display device, but also generally to a display device of the active matrix type, such as an OLED. The scanner of this invention is also usable as a scanner of an image pickup device, a memory circuit, a counter circuit or the like.

The entire disclosure of Japanese Patent Application No. 2009-053031, filed Mar. 6, 2009 is expressly incorporated by reference herein.

What is claimed is:

1. A scanner comprising:

a plurality of unit circuits configured with transistors of a same conductivity type, wherein the unit circuit constituting the scanner includes an output transistor that selectively outputs, to an output terminal of the unit circuit, a signal given from an outside, a gate electrode of the output transistor is connected to one end of a voltage limiting transistor, and a gate electrode of the voltage limiting transistor is supplied with a first power supply potential, and wherein the unit circuit constituting the scanner includes a cutoff switch that turns to a conductive state by an output signal from another unit circuit and writes a second power supply potential into the gate electrode of the output transistor to cut off the output transistor, and the cutoff switch is connected to an end of the voltage limiting transistor, the end being other than the one end thereof.

2. The scanner according to claim 1, wherein the unit circuit constituting the scanner includes a control switch that turns to a conductive state at timing when the output transistor turns to a conductive state and writes a second power supply potential into one end thereof, and the control switch is connected to an end of the voltage limiting transistor, the end being other than the one end thereof.

3. The scanner according to claim 1, wherein the unit circuit constituting the scanner includes a reset switch that writes a second power supply potential into the gate electrode of the output transistor at least immediately after a power supply is turned on, and the reset switch is connected to an end of the voltage limiting transistor, the end being other than the one end thereof.

4. An electro-optical panel comprising:

the scanner according to claim 1;

a plurality of scan lines; and a plurality of pixel switching elements which are connected to the plurality of scan lines and are arranged in a matrix fashion, wherein the output terminals of the plurality of unit circuits which constitute the scanner are connected to the plurality of scan lines.

5. An electro-optical display device comprising:

the electro-optical panel according to claim 4.

6. An electronic apparatus comprising:

the electro-optical display device according to claim 5.

* * * * *